United States Patent [19]

Giebel

[11] Patent Number: 4,653,133

[45] Date of Patent: Mar. 31, 1987

[54] SHOE MACHINE

[75] Inventor: Gerhard Giebel, Bad Soden, Fed. Rep. of Germany

[73] Assignee: USM Corporation, Farmington, Conn.

[21] Appl. No.: 895,776

[22] Filed: Aug. 12, 1986

[30] Foreign Application Priority Data

Aug. 27, 1985 [DE] Fed. Rep. of Germany ..... 3530568

[51] Int. Cl.[4] ..... A43D 25/047; A43D 21/12; A43D 21/00

[52] U.S. Cl. ..... 12/8.8; 12/10.5; 12/12.2; 12/12.4

[58] Field of Search ..... 12/8.71, 8.81, 10.21, 12/10.41, 10.71, 12.2, 12.21, 12.4, 12.41, 73.5, 123, 125, 11.3, 10.8, 77, 8.7, 8.8, 7.8, 10.5; 69/6.5

[56] References Cited

U.S. PATENT DOCUMENTS

| | | | |
|---|---|---|---|
| 1,261,483 | 4/1918 | Brock | 12/8.81 |
| 3,101,495 | 8/1963 | Peterson | 12/12.4 |
| 3,164,852 | 1/1965 | Bowrer et al. | 12/10.5 |
| 4,319,373 | 3/1982 | Lauckhardt et al. | 12/10.5 |
| 4,407,033 | 10/1983 | Garner et al. | 12/10.1 |
| 4,530,124 | 7/1985 | Sommer | 12/12.2 |

FOREIGN PATENT DOCUMENTS

| | | | |
|---|---|---|---|
| 0100636 | 2/1984 | European Pat. Off. | 12/12.2 |
| 2021376 | 11/1971 | Fed. Rep. of Germany | 12/12.4 |

*Primary Examiner*—Werner H. Schroeder
*Assistant Examiner*—Steven N. Meyers
*Attorney, Agent, or Firm*—Spencer T. Smith

[57] ABSTRACT

In a lasting machine shoes are supported with one end aligned with end lasting instrumentalities arranged to operate at that one end, and with the other end thus offset to the longitudinal center line of the instrumentalities (and thus of the machine). The support for the other end of the shoe includes a sensing arrangement mounted to slide transversely of the shoe. The sliding movement serves to distinguish left and right shoes and also to sense the amount of the offset. In addition the length of the shoe is measured from its initial lengthwise clamping. The various measurements are made electronically, e.g. using linear potentiometers. The signals are supplied to a control device (microprocessor) by which control signals are supplied to motors, e.g. stepping motors, for controlling tools, e.g. adhesive applying nozzles, to guide the latter along the sides of the shoe.

5 Claims, 4 Drawing Figures

SHOE MACHINE

BACKGROUND OF THE INVENTION

This invention is concerned with improvements in or relating to shoe machines, more especially with methods of and apparatuses for compensating for defects in clamping shoes or shoe components which are placed in a shoe machine, wherein a shoe treatment tool, e.g. an adhesive applicator nozzle, is moved automatically relative to the shoe or component to be treated along an operating path determined by longitudinal and transverse coordinates by means of a control device storing the coordinates, the lateral relative position of the operating path to the shoe or shoe component being determined by a measured dimension sensed on the clamped shoe or component.

One such method is described in DE-C No. 3341118 in association with a cement toe and side lasting machine wherein, it will be appreciated where shoes loaded by hand may be subject to a certain lateral offset from the optimum position. In order to avoid compensating for this by undesired adjustment operations, it is proposed in said specification to progressively sense the periphery of the shoe using a feeler, as the tool, viz. adhesive applicator nozzle is moved longitudinally along the shoe bottom. Furthermore in such case it is considered advantageous to sense the periphery of the outer side of the shoe, where the periphery is relatively sharply defined, rather than of the inner side of the shoe where, because of the sharply reentrant irregular shape of the last, the shoe is unsuitable for sensing. The result of this sensing of the outside of the shoe is then combined in the control device with the particular stored transverse coordinates for the operating path along the inside of the shoe in such a manner that this path can be correspondingly corrected continuously during the longitudinal movement of the tool. In addition, the result of the sensing is compared with the stored transverse coordinates for the operating path along the outside of the shoe and the thus imparted differential value is arrived at for calculating the correction of the operating path along the inside of the shoe.

For implementing the above-described method, viz. for the transverse movement of the adhesive applicator nozzle which runs along the inner periphery of the shoe an appropriate apparatus is used which comprises a servomotor supported opposite the feeler sensing the outer periphery of the shoe, whereby an initial position given by the corresponding disposition of the feeler is supplied to the servomotor. The servomotor must then, in the case of a shoe region the width of which is increasing, e.g. in the direction of the toe to the ball, compensate for a path length which takes into account both the outwardly directed movement of the feeler and also the outwardly directed movement of the inner adhesive nozzle opposing it. This inner adhesive nozzle is to some extent drawn by the feeler in the wrong direction, which must be compensated for by a correspondingly quicker operation of the servomotor. This leads, in the case of fast movements of the nozzles in the sense of a fast execution of the operation, to significant acceleration forces to which the feeler is subjected, since the servomotor is arranged to be supported for these movements opposite the feeler. These forces can be accommodated only if the feeler engages the outer periphery of the shoe under a relatively high pressure.

The sensing of the outer periphery of the shoe by means of a feeler is made difficult if the adhesive nozzles are to be effective in a region which is covered laterally by pulling over pincers, as are necessary for toe lasting. In this case the pulling over pincers or, as the case may be, the upper tensioned by them over the insole edge prevent the feeler from properly engaging the shoe and thus its movement along the outer periphery of the shoe. Furthermore, the feeler, which is to be continuously moved, requires a guide which extends over the length of the shoe being operated upon, giving rise to further constructional requirements.

It is the object of the present invention to determine and compensate, in an especially simple and above all speedy manner, for defects in the clamping of shoes.

BRIEF SUMMARY OF THE INVENTION

The invention thus provides a shoe machine which supports a lasted shoe within a range of lateral positions with the bottom surface presented for engagement by a shoe treatment tool, comprising shoe treatment tool means adapted to be displaced laterally and longitudinally along a predetermined path over the bottom surface of a supported lasted shoe, means for engaging one end of the supported lasted shoe, means for supporting said engaging means for lateral sliding movement so that said engaging means will automatically shift to a selected lateral position relative to the supported lasted shoe when said supporting means is longitudinally advanced to a selected advanced position relative to the supported lasted shoe, means for longitudinally advancing said supporting means to said advanced position, means for generating a signal representative of the actual lateral position of said engaging means when said supporting means is at the selected advanced position so that the path of movement of said shoe treatment tool can be corrected to reflect the actual lateral position of the supported lasted shoe within its range of lateral positions.

It will be appreciated that in using this machine any lateral offset disposition (constituting a defect in clamping) is indicated at the earliest possible moment, namely before the start of the movement of the shoe treatment tool along the operating path, and in consequence the transverse coordinates stored in the cohtrol device are immediately corrected accordingly for the whole of the treatment process. It is thus not necessary to recalculate individually from longitudinal coordinate to longitudinal coordinate the associated transverse coordinate, but rather one can allow the movement of the shoe treatment tool to proceed as quickly as it can operate. The construction of the measuring slide is in this case merely to be determined according to the measurement which is to be carried out by it laterally in the region of the one shoe end; that is to say, it can be immediately effective after the shoe or component has been placed in the shoe treatment machine, without any need for a special guidance arrangement for the measuring slide.

Because of the shape of a shoe, especially as viewed from the shoe bottom, by clamping one end of a shoe, or of a component forming part of the shoe bottom in the finished shoe, in a predetermined location the other end invariably exhibits a lateral offset disposition. In accordance with the present invention, therefore, the signal provided by the means for providing the measurement value being a measure for the particular offset disposition, can be used to indicate the offset for a right or left shoe or shoe bottom component, as the case may be, so that the signal can also be used for purposes of right-left sensing.

In one machine in accordance with the invention, wherein the lasting region extends from the toe in the direction of the heel seat, viz. a toe lasting machine, a heel support is provided with which the measuring slide is connected in such a manner that the particular disposition of the heel support, which is dependent upon the shoe length, determines the position of the measuring slide in the longitudinal direction of the shoe, the measuring slide being connected with electrical means for providing the measurement value, which means registers the lateral disposition of the heel seat region of the shoe.

In the machine in accordance with the invention, wherein the lasting region extends from the heel seat in the direction of the toe, viz. a heel seat lasting machine, a toe support is provided with which the measuring side is connected in such a manner that the disposition of the toe support, which is dependent upon shoe length, determines the position of the measuring slide in the longitudinal direction of the shoe, the measuring slide being connected with electrical means for providing the measurement value, which means registers the lateral position of the toe region of the shoe.

The positioning of the measuring slide, dependent upon shoe length, can be used for a size determination of the shoe.

One or two opposed independent transversely movable sensors can be used as the measuring slide, which sensors engage at the heel seat region or toe region of the shoe, as the case may be. It is however also possible to use as a measuring slide a V-block of the heel support or toe support, as the case may be, which V-block is mounted for free movement in a direction transverse to the longitudinal axis of the shoe.

BRIEF DESCRIPTION OF THE DRAWINGS

To illustrate the present invention a number of embodiments are hereinafter described with reference to the accompanying drawings. It will of course be appreciated that these embodiments have been selected for description merely by way of non-limiting example.

In the accompanying drawings.

DETAILED DESCRIPTION OF THE PREFERRED EMBODIMENTS OF THE INVENTION

Figure 1:
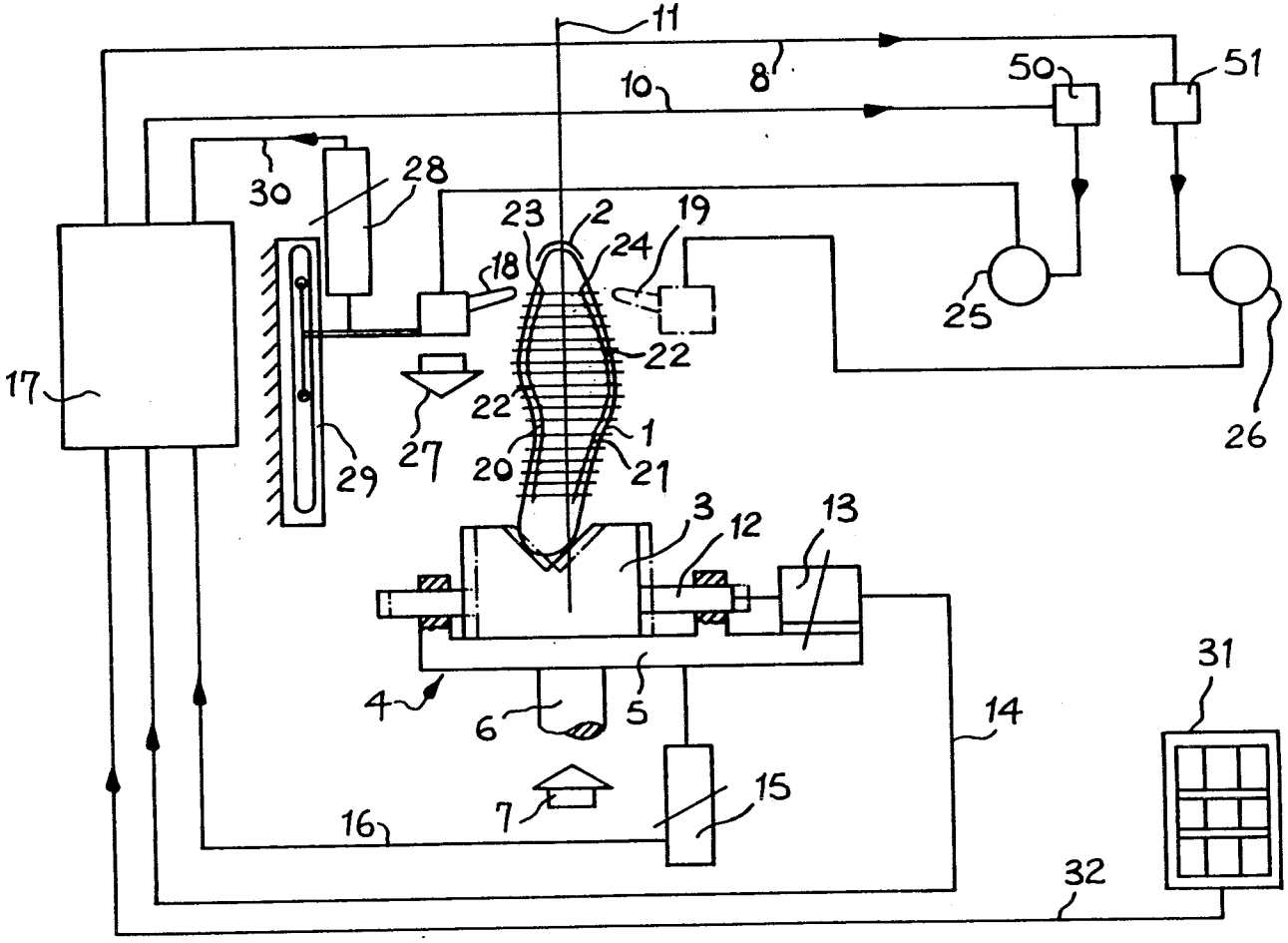
FIG. 1 shows schematically a toe lasting machine and control circuit therefor, wherein a V-block of a heel support thereof is used as the measuring slide.

In a first embodiment of the invention, the control circuit shown in FIG. 1 relates to a toe lasting machine having a heel support, wherein the lasting region extends from the toe in the direction of the heel seat. The construction of such a machine is known, as e.g. illustrated and described in EP-A No. 55107. FIG. 1 shows a lasted shoe 1, which at its toe is determined as to its position by a so-called spreader 2 and is held at its heel end by a V-block 3. The V-block 3 is a component part of a heel support 4, which consists of the V-block 3, a slide guide 5 and a carrier 6, which is secured to the machine frame in a mounting (not shown). The carrier 6 and thus the parts secured thereto are movable (in the direction of the arrow 7) against the shoe after it has been placed in the machine; such operation is conventional and further details need rot be provided.

The V-block 3 is mounted for free movement on the slide guide 5 transversely of the shoe 1, so that a lateral deviation of the heel end (shown in continuous line) of a shoe 1 from the normal position (shown in chain-dot line) can be sensed by the V-block 3, by the latter automatically moving transversely to accommodate to the offset disposition (constituting a defect in clamping). As is conventional in toe posting machines pulling over pincers are provided which are operable in the toe region and by which the operator can be guided when loading the shoe in the machine. Consequently in practice, when shoes are loaded in a machine of this type, the deviations from the normal position which may arise are unlikely to be such that any left-right sensing of the shoe, described further below, would be upset.

As shown in FIG. 1, the V-block 3 is moved laterally to the left in relation to the normal position (shown in chain-dot line), particularly because of the lateral offset disposition shown of the heel end portion of the shoe 1. Coupled to the V-block 3, which works as a measuring slide, is a plunger 12 which actuates a linear potentiometer 13 acting as means for providing the measurement value, in which potentiometer, as a result of the positioning of the plunger 12, a certain resistance value arises, which is signalled via signal line 14. Furthermore, there is connected with the slide guide 5, a further linear potentiometer 15 which, according to the end setting of the carrier 6, when the V-block 3 is moved against the shoe 1, is correspondingly set and signals via signal line 16 the resistance value imparted thereby. With the aid of the linear potentiometer 15 a measurement value is imparted which corresponds to the size of the shoe 1 placed in the machine. The measurement values given via the signal lines 14 and 16 are supplied to the control device 17 in which the two measurement values are combined for controlling the movement of two adhesive nozzles 18 and 19, about which more detail is explained below.

By means of the adhesive nozzles 18 and 19 an adhesive stripe is applied over the shoe 1 along two operating paths 20 and 21, each of which is determined by longitudinal and transverse coordinates defining individual coordinate section points 22. The longitudinal and transverse coordinates of the two operating paths 20 and 21 are digitally stored in a control device 17. For applying the adhesive strips along the operating paths 20 and 21 the adhesive nozzles 18 and 19 are advanced in a conventional manner from a rest position (shown in FIG. 1) to start points 23 and 24 and then are guided over the shoe bottom of the shoe 1. For this purpose, firstly a conventional drive device 29 is used for longitudinal advancing movement of each nozzle along the shoe 1 (indicated by the arrow 27), and further conventional drive devices in the form of stepping motors 25 and 26 are provided for the transverse movement of the adhesive nozzles 18 and 19. Connected with the drive device 29 is a linear potentiometer 28 which, according to the disposition of the adhesive nozzle 18 along its operating path 20, signals a resistance value which is supplied via signal line 30 to the control device 17. The adhesive nozzle 19 is moved likewise by the drive device 29 along the operating path 21 (omitted for reasons of clarity).

In this way the control device receives on the one hand via signal line 30 a signal defining the particular disposition of the adhesive nozzles 18 and 19 in the longitudinal direction of the shoe 1, by which signal the particular longitudinal coordinate is determined, and on the other hand via the signal lines 14 and 16 a signal relating to the size of the shoe 1 together with signals relating to a possible offset of the shoe 1 in combination with a right-left signal. The signals relating to the possible offset and the size of the shoe 1 are supplied before the start of the movement of the adhesive nozzles 18 and 19 over the shoe 1, so that the control device 17, before the start of the movement of the adhesive nozzles 18 and 19 from the initial points 23 and 24, can impart the particular corrected operating path 20 or 21 as the case may be, in which both the shoe size, the left-right indicator and the possible offset of the shoe 1 is taken into account. To this end, the control device 17 has merely to add to the transverse coordinates stored digitally therein a positive or negative correction value which is provided by combining the signal indicating the offset (signal line 14) with the signal indicating the shoe size (signal line 16), this correction value correcting that transverse coordinate which is stored in the control device 17 for the normal disposition of the shoe. The control device 17 provides its control signal to the stepping motors 25 and 26 via signal lines 8 and 10 and via amplifiers 50 and 51.

The control unit 17 of the machine now being described is a microprocessor with digital memory; such microprocessors and their mode of operation are well known and conventional.

In the foregoing description it has been assumed that extreme offset positions of a shoe 1, which are immediately apparent to the operator, do not in practice arise, since, as already stated, the operator will have sufficiently available reference points for loading a shoe 1 approximately to the normal disposition. For this reason one can furthermore assume that a right shoe when loaded is disposed with its heel end portion always to the left of the axis of symmetry 11 of the toe region of the shoe (and of the array of pincers), and vice versa in the case of a left shoe. FIG. 1 shows clearly how the illustrated right shoe is inserted in the machine with its heel end portion offset to the left in relation to the axis of symmetry 11. The fact that, even with defects in clamping, right shoes are always sensed by the V-block 3 with the heel end portion offset to the left, left shoes on the other hand with the heel end portion offset to the right, can now be used to distinguish between right and left shoes directly by the setting of the V-block 3. The resistance value signalled by the linear potentiometer 13 thus has an indication as to whether it is a question of a right or left shoe, the resistance value of the linear potentiometer 13 also indicating by what amount the shoe lies in the machine offset to the axis of symmetry 11. The control device 17, which receives appropriate signals from the linear potentiometer 13, can consequently supply the particular coordinates and correction values for the stepping motors 25 and 26.

In FIG. 1 is also shown a keyboard 31 by which a signal characterising the particular shape of the shoe to be treated is transmitted via signal line 32 to the control device 17. On the basis of this signal the control device 17 is informed as to which operating path 20 or 21, as the case may be, is to be followed, i.e. which longitudinal and transverse coordinates stored therein to be recalled for the treatment of the particular shoe 1, so that the correction which arises on the basis of the position of the two linear potentiometers 13 and 15 then only relates to the shoe shape defined by the key board 31 and accordingly the stepping motors 25 and 26 receive their commands for this shoe shape from the control unit 17.

Figure 2:
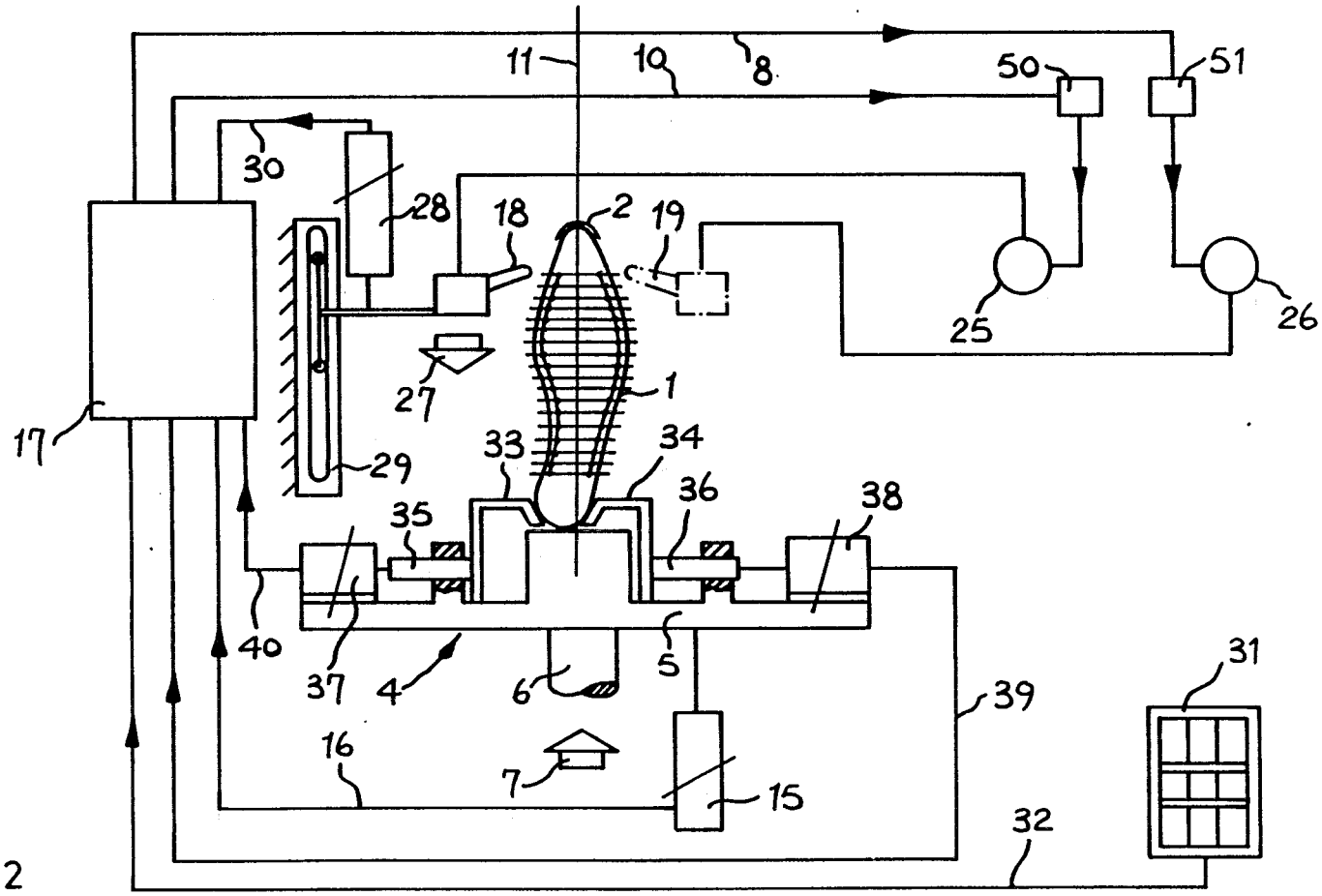
FIG. 2 shows schematically a lasting machine and control circuit similar to that of FIG. 1, but wherein two opposed sensors are used as measuring slides.

In a second embodiment of the invention, the control circuit shown in FIG. 2 also forms part of a toe lasting machine, but is distinguished from that of FIG. 1 only in that, instead of the V-block 3, two opposed independent, transversely movable sensors 33 and 34 are used, which here serve as the measuring slides. The two sensors 33 and 34 are connected via rods 35 and 36 to linear potentiometers 37 and 38, which operate as means for providing measurement values. Thus, as a result of the setting of the rods 35 and 36, a certain resistance value arises in each of the potentiometers 37 and 38, which value is signalled via signal lines 39 and 40 to the control device 17. The two sensors 33 and 34 press against the heel seat region of the shoe 1, for which purpose they are subject to spring tension or pneumatic pressure, independently of one another, and thus the sensors 33 and 34 are transversely movable independently of one another. From the signal supplied by the two linear potentiometers 37 and 38 a mean value is calculated in the control device 17, which value corresponds to the signal supplied via the signal line 14 in accordance with FIG. 1. With relation to the further construction of the apparatus of FIG. 2 and the method operating in this apparatus, reference should be made to FIG. 1 and its accompanying description.

Figure 3:
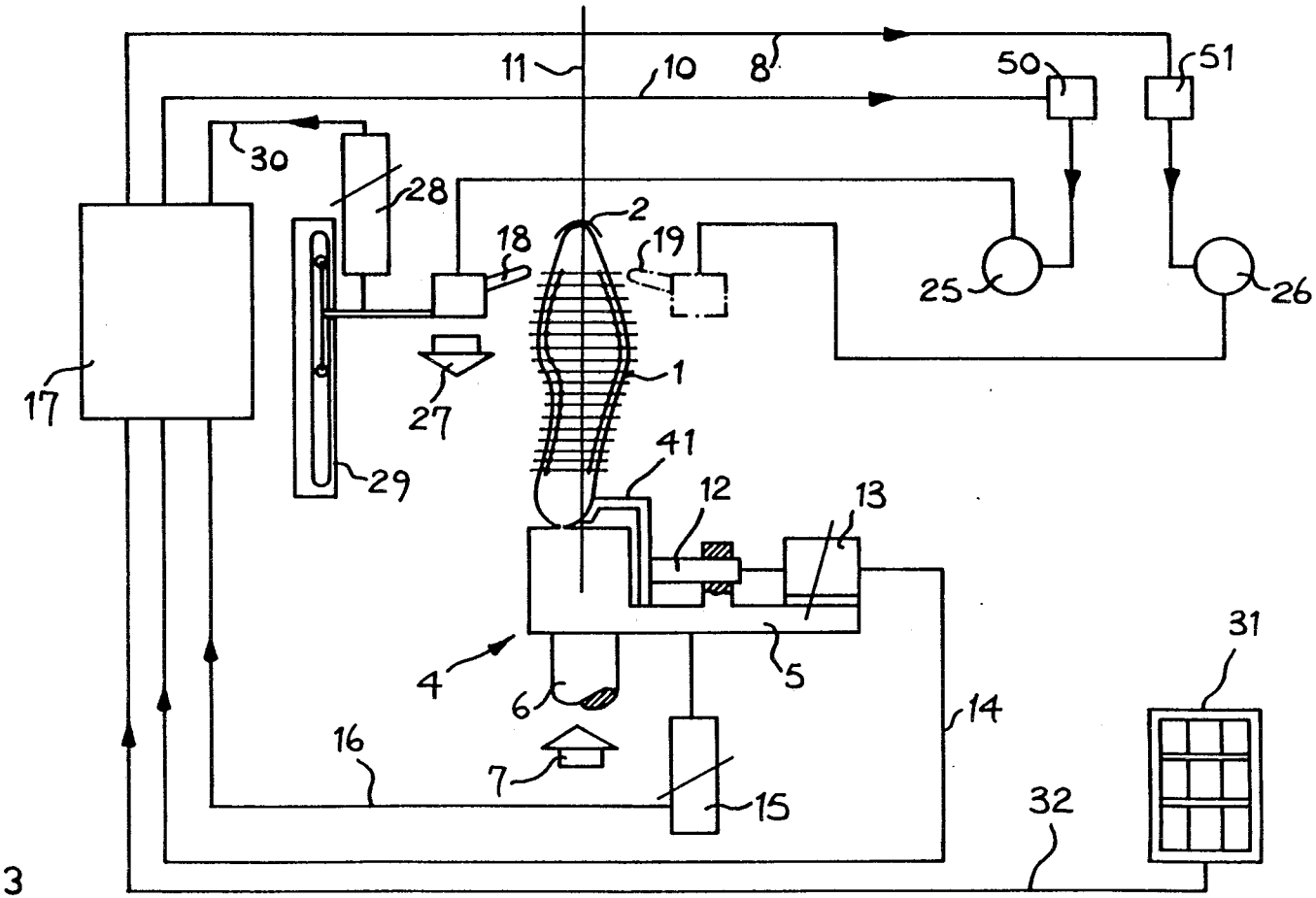
FIG. 3 shows schematically a lasting machine and control circuit similar to that of FIG. 1, wherein one sensor is used as a measuring slide.

In a third embodiment of the invention, the control circuit shown in FIG. 3 also forms part of a toe lasting machine, but is distinguished from those of FIGS. 1 and 2 merely in that, instead of the V-block 3 or the two sensors 33 and 34, as the case may be, only one sensor 41 is provided, which is moved against the heel seat region of the shoe 1. As in the apparatus according to FIG. 1, this sensor 41 via the rod 12 actuates the linear potentiometer 13 which supplies a signal to the control device 17. With regard to the further operating of this apparatus, reference should be made to FIG. 1 and its accompanying description.

The V-block 3 can be utilised for the measurement of the offset disposition (see FIG. 1) essentially because of the disposition of the inclined surfaces thereof at opposite sides of the heel seat region of the shoe 1, such that the V-block 3 is always set on the centre line of the heel seat region, regardless of whether it is a question of right or left shoe. This is also the case where the two sensors 33 and 34 (FIG. 2) are used. In the case of the measurement with only one sensor 41 (see FIG. 3), because only one side of the heel seat region of the shoe 1 is engaged it may be possible for incorrect sensing to take place. To avoid this possibility, the automatic right-left sensing by evaluation of the signal supplied via the signal line 14 or 39/40, as the case may be, may be dispensed with and the right-left determination be transferred to the key board 31; in such a case, an appropriate signal defining either a right or a left shoe, would be supplied via the signal line 32 to the control device 17. To this end the apparatus comprises a switching mechanism which switches alternately from right to left or vice versa at the end of each operating cycle, since in the normal treatment of shoes left and right shoes are alternatively presented. If exceptionally one right shoe were to follow another provision is made in the control device for manual switching via the key board 31.

Figure 4:
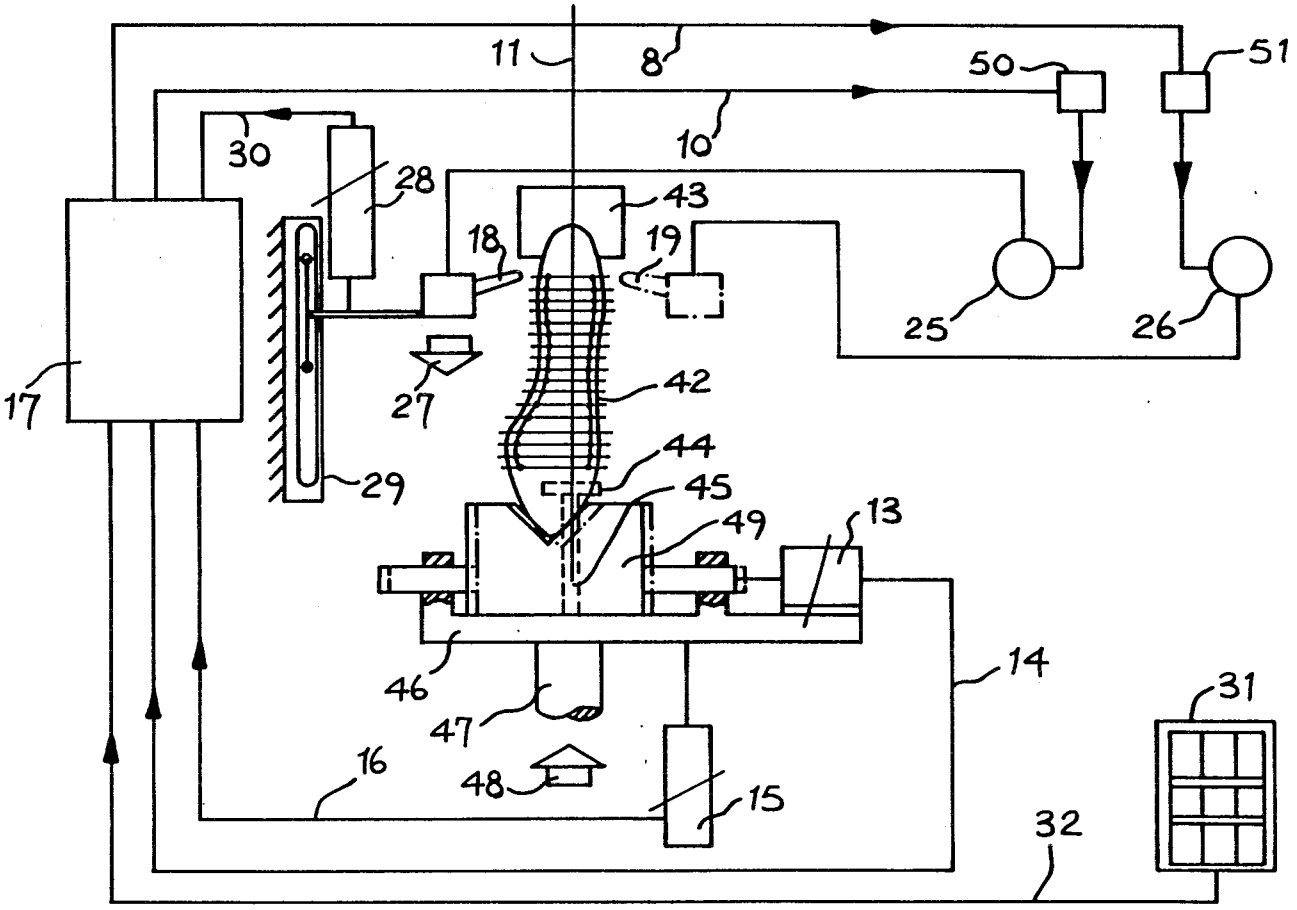
FIG. 4 shows schematically a heel seat lasting machine and control circuit therefor, wherein a V-block of a toe support thereof is used as the measuring slide.

In a fourth embodiment of the invention, the control circuit shown in FIG. 4 forms part of a heel seat lasting machine provided with a toe support, wherein the lasting region extends from the heel seat in the direction of the toe. The construction of such a machine is known, e.g. as illustrated and described in EP-A No. 58471. This machine comprises, as is conventional, a heel band 43 which, when a shoe 42 is loaded in the machine, receives the heel end and positions it. The machine is furthermore provided with a toe rest 44 which is shown in part-dotted line disposed beneath the shoe 42. The toe support 44 is mounted on an arm 45 which is secured to a slide guide 46. The slide guide 46 is connected with a carrier 47 which in known manner can be advanced (in the direction of the arrow 48) towards the loaded shoe 42 in order to support the shoe 42 in the machine. The toe of the shoe 42 is received by a V-block 49 which is moved transversely according to the position of the shoe. In this way the V-block 49 corresponds in its effectiveness to the V-block 3 in accordance with FIG. 1. The further component parts shown in FIG. 4 correspond with those shown in FIG. 1 and are therefore provided with the same reference numerals. With regard to the operation of the apparatus and the control circuit of FIG. 4, reference is made thus to FIG. 1 and its accompanying description.

In the exemplary embodiments shown in FIGS. 1 to 4, the shoe treatment tool is constituted by an adhesive applicator nozzle. However other shoe treatment tools can also be controlled in the same way, for example in connection with an apparatus according to FIG. 4, a so-called tacker device by which tacks are driven in over the side region of shoes.

I claim:

1. A shoe machine which supports a lasted shoe within a range of lateral positions with the bottom surface presented for engagement by a shoe treatment tool, comprising shoe treatment tool means adapted to be displaced laterally and longitudinally along a predetermined path over the bottom surface of a supported lasted shoe, means for engaging one end of the supported lasted shoe, means for supporting said engaging means for lateral sliding movement so that said engaging means will automatically shift to a selected lateral position relative to the supported lasted shoe when said supporting means is longitudinally advanced to a selected advanced position relative to the supported lasted shoe, means for longitudinally advancing said supporting means to said advanced position, means for generating a signal representative of the actual lateral position of said engaging means when said supporting means is at the selected advanced position so that the path of movement of said shoe treatment tool can be corrected to reflect the actual lateral position of the supported lasted shoe within its range of lateral positions.

2. A shoe machine according to claim 1, wherein said engaging means comprises a V-block.

3. A shoe machine according to claim 1, wherein said engaging means comprises an inclined surface and a longitudinally stop surface.

4. A shoe machine according to claim 1, wherein said shoe treatment tool means is an adhesive nozzle.

5. A shoe machine according to claim 1, further comprising means for generating a signal representative of the length of the supported lasted shoe.

* * * * *